US012709443B2

(12) United States Patent
Van Der Molen

(10) Patent No.: US 12,709,443 B2
(45) Date of Patent: Aug. 18, 2026

(54) CLOSURE ASSEMBLY WITH A CAP HAVING CORRUGATED WINGS

(71) Applicant: SIG Services AG, Neuhausen am Rheinfall (CH)

(72) Inventor: Peter-Jan Van Der Molen, SX Tilburg (NL)

(73) Assignee: SIG Services AG, Neuhausen am Rheinfall (CH)

( * ) Notice: Subject to any disclaimer, the term of this patent is extended or adjusted under 35 U.S.C. 154(b) by 0 days.

(21) Appl. No.: 18/870,374

(22) PCT Filed: May 24, 2023

(86) PCT No.: PCT/EP2023/063962

§ 371 (c)(1),
(2) Date: Nov. 27, 2024

(87) PCT Pub. No.: WO2023/227679

PCT Pub. Date: Nov. 30, 2023

(65) Prior Publication Data

US 2025/0326534 A1 Oct. 23, 2025

(30) Foreign Application Priority Data

May 27, 2022 (NL) ..... 2032005

(51) Int. Cl.
*B65D 41/04* (2006.01)
*B65D 75/58* (2006.01)

(52) U.S. Cl.
CPC ..... *B65D 41/0485* (2013.01); *B65D 75/5883* (2013.01); *B65D 2251/02* (2013.01); *B65D 2251/065* (2013.01)

(58) Field of Classification Search
CPC ..... B65D 41/0485; B65D 75/5883; B65D 2251/02; B65D 2251/065; B65D 55/16;
(Continued)

(56) References Cited

U.S. PATENT DOCUMENTS 5,188,250 A 2/1993 Kovacic
D425,965 S * 5/2000 Yuen ..... D23/233
(Continued)

FOREIGN PATENT DOCUMENTS

WO 2020221801 A1 11/2020
WO 2022079154 A1 4/2022

*Primary Examiner* — Ernesto A Grano
(74) *Attorney, Agent, or Firm* — The Watson IP Group; Jovan N. Jovanovic

(57) ABSTRACT

A closure assembly for a container, comprises a spout (1, 3) and a rotational cap (2) injection moulded of plastic material. The cap comprises a top wall (2*a*) and a downward depending skirt (2*b*). The cap has two wings (5), which are integrally moulded of plastic material and extend vertically and outward in a lateral direction over a wing length in substantially opposite directions from an inner end to a tip. The wings each have a base portion, a center portion, a top portion, and opposite front and back sides. At least the center portion of each wing is connected to the skirt of the cap. The base portion and the top portion of each wing are substantially flat. The center portion of each wing comprise at least one corrugation (12, 12', 12") that extends along a part of the length of the wing and forms a groove on both sides of the wing, which grooves of the corrugation, as seen from a sideways view of the wing, together form an alternating waveform, e.g. a sinusoidal shape.

19 Claims, 10 Drawing Sheets

Figure 1:
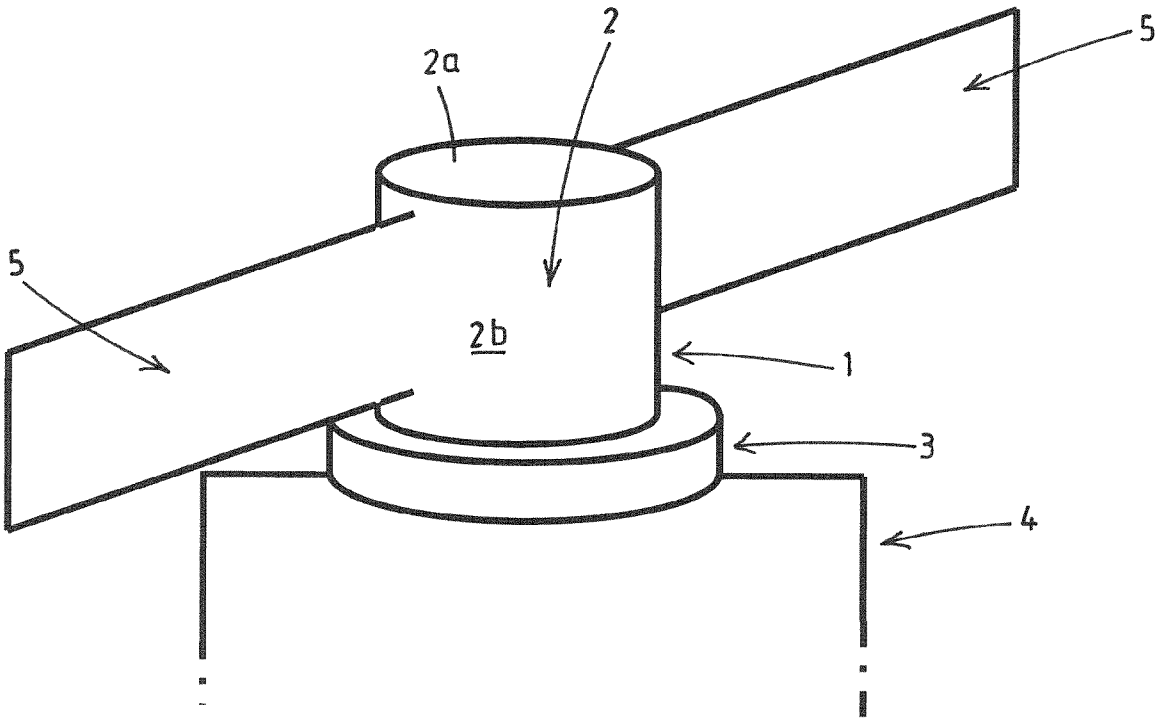

(58) Field of Classification Search
CPC ..... B65D 2213/00; B65D 2575/586; B65D 41/17
USPC ..... 215/295
See application file for complete search history.

(56) References Cited

U.S. PATENT DOCUMENTS 7,431,529 B1 * 10/2008 Rushe ..... B65D 1/0238 401/133
D631,346 S * 1/2011 Schwartz ..... D9/443
D682,693 S * 5/2013 Cocuzzi ..... D9/443
D687,719 S * 8/2013 Last ..... D9/709
D704,058 S * 5/2014 Last ..... D9/451
D786,672 S * 5/2017 van Spronsen ..... D9/443
D787,328 S * 5/2017 van der Molen ..... D9/451
D799,322 S * 10/2017 Tamarindo ..... D9/451
D803,054 S * 11/2017 van Spronsen ..... D9/443
D813,669 S * 3/2018 Pentland ..... D8/45
D885,893 S * 6/2020 Tamarindo ..... D9/451
D913,093 S * 3/2021 Van Den Hoonaard ..... A63H 33/08 D9/443
D971,728 S * 12/2022 Williamson ..... D9/435
D984,260 S * 4/2023 Wommelsdorf ..... D9/443
11,884,459 B2 * 1/2024 Fiere ..... B65D 55/16
D1,022,693 S * 4/2024 Buzzi ..... D9/443
D1,023,752 S * 4/2024 Buzzi ..... D9/443
12,006,120 B2 * 6/2024 Van Spronsen ..... B65D 41/17
D1,038,755 S * 8/2024 Gierse ..... D9/443
2003/0127472 A1 * 7/2003 Doherty ..... B65D 1/095 222/541.5
2004/0238564 A1 * 12/2004 Bourque ..... B65D 75/5883 222/92
2016/0114922 A1 * 4/2016 Boira Bonhora ..... A61J 1/1431 383/42
2019/0193899 A1 * 6/2019 Van Der Molen ..... B65D 41/47
2021/0354896 A1 * 11/2021 Fiere ..... B65D 75/5883
2022/0112008 A1 * 4/2022 Buzzi ..... B65D 75/5883
2022/0204235 A1 * 6/2022 Van Spronsen ..... B65D 41/17
2022/0227542 A1 * 7/2022 Branca ..... B65D 41/3447
2023/0278757 A1 * 9/2023 Wommelsdorf ... B65D 41/3404 220/262
2023/0348155 A1 * 11/2023 Fiere ..... B65D 41/3428
2024/0336417 A1 * 10/2024 Van Spronsen .... B65D 75/5883
2025/0058938 A1 * 2/2025 Buzzi ..... B65D 39/0029

* cited by examiner

CLOSURE ASSEMBLY WITH A CAP HAVING CORRUGATED WINGS

The present invention relates to a closure assembly configured to be mounted to a container.

Closure assemblies are known with a plastic cap that is releasably attached to a neck of a spout fitted on a collapsible pouch container. Furthermore it is known that such plastic caps are provided with a pair of wings extending from the skirt on opposing sides of the cap. The wings of such a closure assembly can aid in opening the closure assembly mounted on the container by allowing a user to manually apply a force upon these wings and thus generating a torque on the cap. Some of these wings might even be provided with, or comprise, an integrated strap as shown in WO2020/221801. However, the provision of such a pair of wings requires the use of additional plastic material for the production of the cap of the closure assembly. Especially since the size of the wings is, in many cases, also determined to be of such size that they prevent the cap of the closure assembly from being accidentally swallowed.

It is desirable to use as little plastic material as possible during the production process of the closure assemblies. Simply reducing the thickness of the wings and thus the amount of material used for the wings while retaining their practical size would result in a reduction of the stiffness of the wings and may cause problems during injection molding and/or during handling of the cap, e.g. during opening of the closure assembly.

In an effort to optimize the required plastic material whilst providing sufficient stiffness of the wings several designs are known, for instance from WO2018/194454.

A problem with current state of the art is that the industry is now approaching a limit in the amount of material that can be removed from the thickness of the wings without the wings losing so much stiffness that they cannot properly perform their initial function of receiving a force and transferring this as a torque to the cap of the closure assembly.

The object of this invention is to provide a novel approach to improving the stiffness of the wings.

An additional benefit or secondary objective is that the necessary amount of plastic material can be further reduced.

The invention provides a closure assembly according to claim 1.

According to the invention an increase in the ability of the wings to convert a force acting perpendicularly upon the sides of the wings by a user into a torque acting upon the cap of the closure assembly is achieved by means of providing each wing with a center portion that includes at least one corrugation. This corrugated center portion adjoins the skirt of the cap and is located between the base portion and the top portion of the wing.

From prior art document U.S. Pat. No. 5,188,250 a twist off closure is known having a cap with wings. The wings may include wing portions that are horizontally rippled for increased strength. These ripples are provide over the entire height of the wing.

According to the invention, the base portion and the top portion are substantially flat. For example, the flat base portion and top portion are located in a common vertical plane.

This lifting or sinking of the corrugations with respect to the substantially flat base portion and substantially flat top portion is beneficial e.g. for production purposes, ease of use, stiffness, storage etc.

The flat base and top portions of the wings have a technical role during the injection moulding. During injection moulding the molten plastic is injected under high pressure into the mould. In order to assure that no leakage between the mold halves occurs a high closing force is required. When edges of the moulded product would be positioned under an angle, as is the case with corrugations extending to the periphery of the wing, such as e.g. in prior art document U.S. Pat. No. 5,188,250, the mold halves have to be aligned very precise and tolerances are very strict.

The mold halves normally used during production of these caps contain a large number of cavities such that a large number of caps is produced during each production cycle.

The slightest misalignment between the mold halves would result in leakage and formation of burrs. Aligning flat surfaces, in particular the flat top and base portions of the wings according to the present invention, is easier than aligning multiple angles surfaces. Hence, according to the invention, the tolerances during injection moulding are alleviated and the chances of leakage are reduced when the flat top and base portion is present.

The at least one corrugation extends along the length of the wing, preferably over a majority of the length, e.g. at least 75% of the length, and forms a groove on each of the sides of the wing. In a sideways view onto the wing, e.g. a sideways cross-sectional view, the corrugation forms an alternating waveform, e.g. a sinusoidal shape.

In a practical embodiment, seen in a view from above, the at least one corrugation in the center portion of the wing tapers off towards the tip of the wing. So, the depth of the grooves associated with the corrugation reduces gradually in direction from the skirt towards the tip of the wing. In an embodiment, the tapering corrugation merges towards to tip of the wing with the substantially flat base portion and substantially flat top portion of the wing, e.g. in a smooth transition. For example, the corrugation tapers into a tip of the wing that is substantially flat.

In a practical embodiment, the at least one corrugation is substantially parallel to the lateral extending direction of the wings.

In a practical embodiment, the one or more corrugations are perpendicular to the vertical main axis of the tubular neck at least in a closed configuration of the closure assembly.

In a practical embodiment, the at least one corrugation extends at an angle with respect to the lateral extension of the wings, e.g. of less than 60 degrees, e.g. of less than 45 degrees.

The depth of the grooves associated with a corrugation is related to the increase in robustness and/or stiffness of the wing. In practical embodiments, the depth is the greatest where the corrugation adjoins the skirt of the cap and then gradually reduces towards the tip of the wing.

Not only the depth of the grooves defined by the corrugation plays a role, but also the height of the grooves is of influence.

The stability achieved by the provision of the corrugation can be predicted by appropriate finite element calculations and/or by the testing of prototypes.

In embodiments, the largest height of the one or more corrugations is less than 80% of the largest height of the wing, e.g. 80% of the largest sum of the height of the base portion, the center portion, and the top portion of the wing.

For example, the largest depth and/or height of the grooves of the at least one corrugation is between 2 mm and 5 mm.

When multiple corrugations are present in the center portion of the wing, the corrugations may be identical in geometry. In other embodiments, they are not identical, e.g. they differ in view of the largest depth and/or largest height of their associated grooves and/or in view of the extension along the length of the wing.

In embodiments, the center portion of the wing is larger than the top portion and/or of the base portion of the respective wing, e.g. the height of the center portion being larger, e.g. larger than the combined maximum height of the top portion and base portion.

In embodiments, the center part of the wing comprises at least two corrugations, wherein these corrugations are formed in opposite directions with respect to a main surface of the wing.

In embodiments, the center part of the wing comprises at least two corrugations.

In embodiments, the center part of the wing comprises corrugations formed in opposite directions, wherein the corrugations are offset from a main surface of the wing such that one of the two sides of the wing does not have any protrusions past its surface as a result of the corrugations.

In embodiments, the increase in stability/stiffness achieved by the provision of the one or more corrugations is most prevalent in the bending stiffness in a direction perpendicular to the opening direction of the cap.

In embodiments, the one or more corrugations as seen from the side of the wing have a sinusoidal shape.

In embodiments, the corrugations as seen from the side of the wing have a shape substantially similar to a square wave.

In embodiments, the tapering of the one or more grooves formed by the corrugation is achieved by decreasing the amplitude of the wave form shape along the length of the wing.

In embodiments, the one or more grooves form an alternating waveform along the length of the groove centered around the main surface of the wing, e.g. incorporating two perpendicularly oriented waveforms over the surface of the wing.

In an embodiment, the alternating waveform along the length of the groove decreases in amplitude along the length of the wing.

The invention will now be explained in more detail with reference to the appended drawings.

Figure 2:
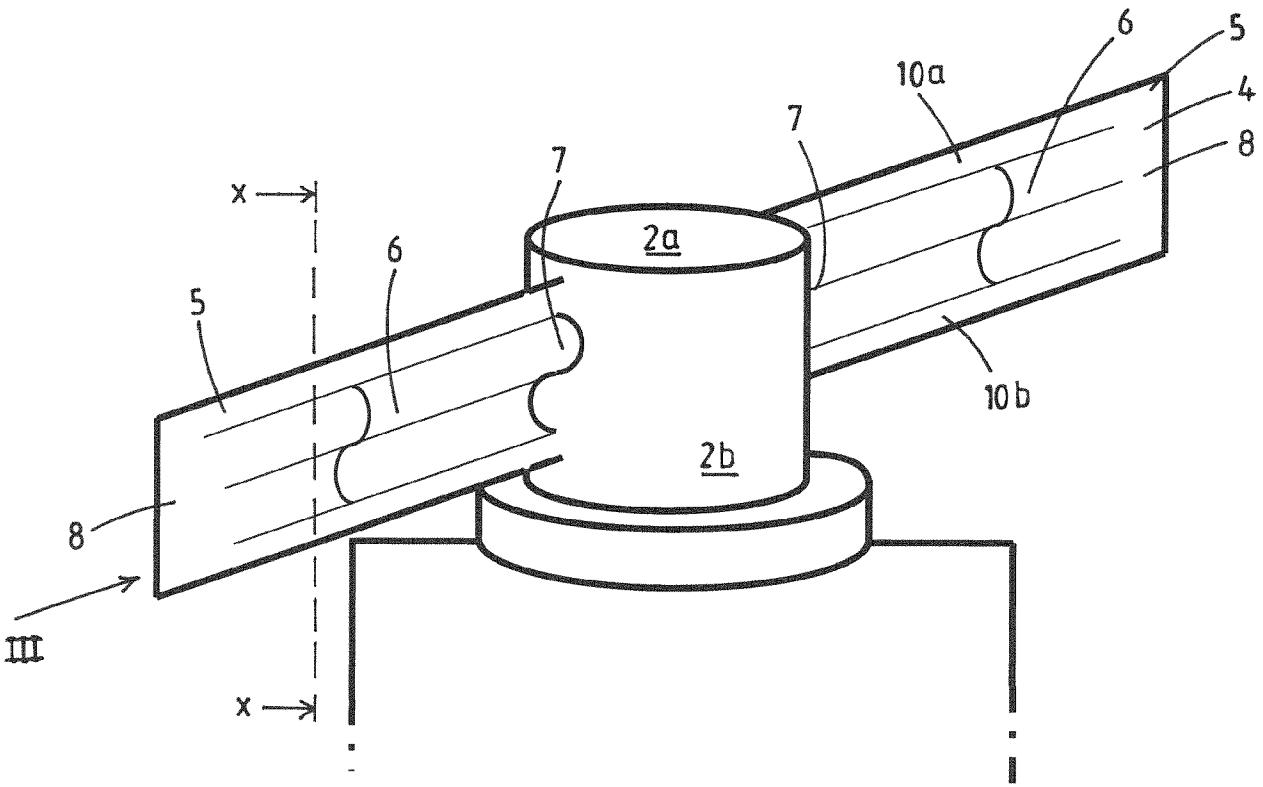
Figure 3D:
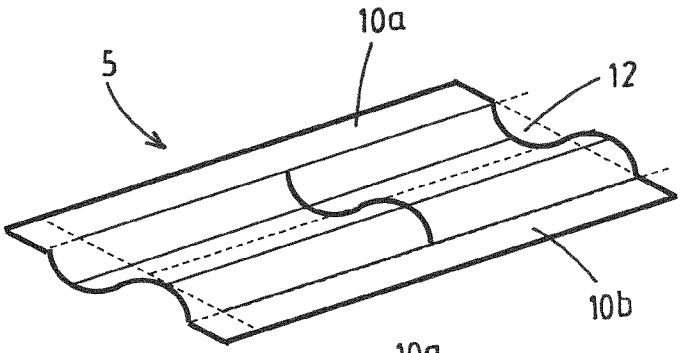
Figure 3E:
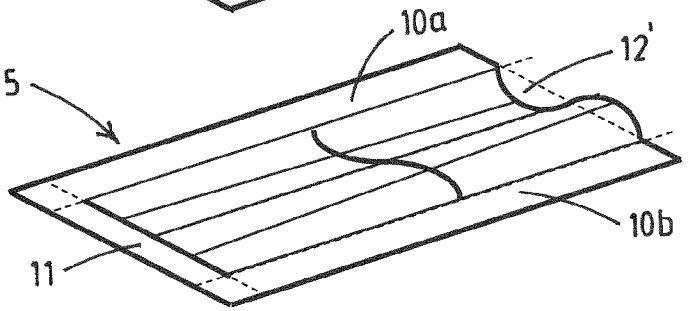
Figure 3F:
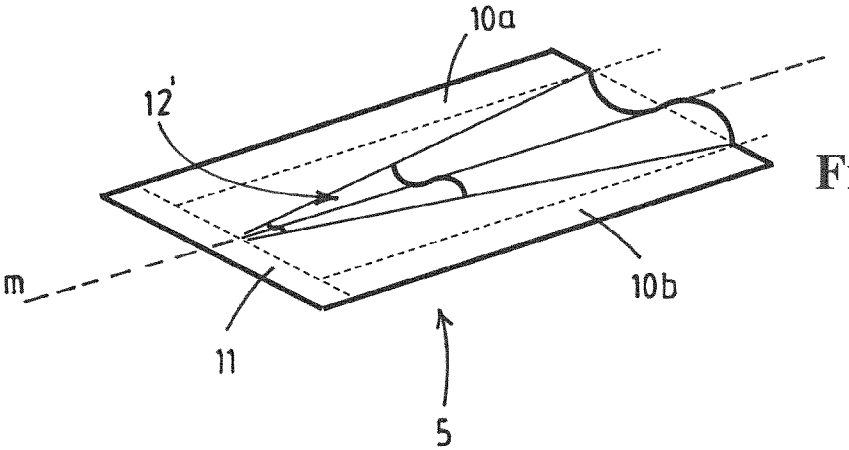
Figures 3A, 3B, 3C:
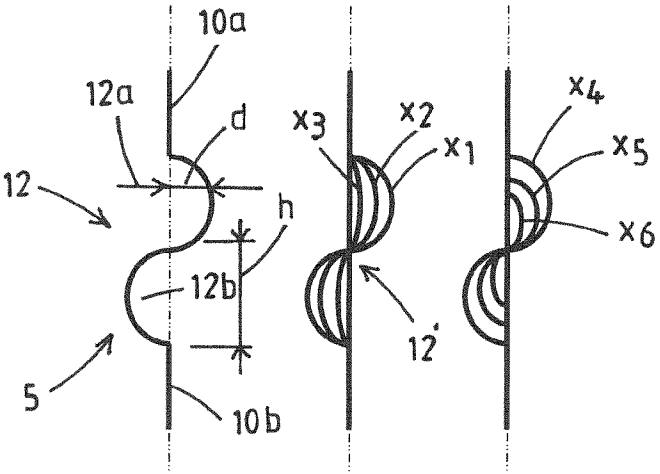
Figure 4B:
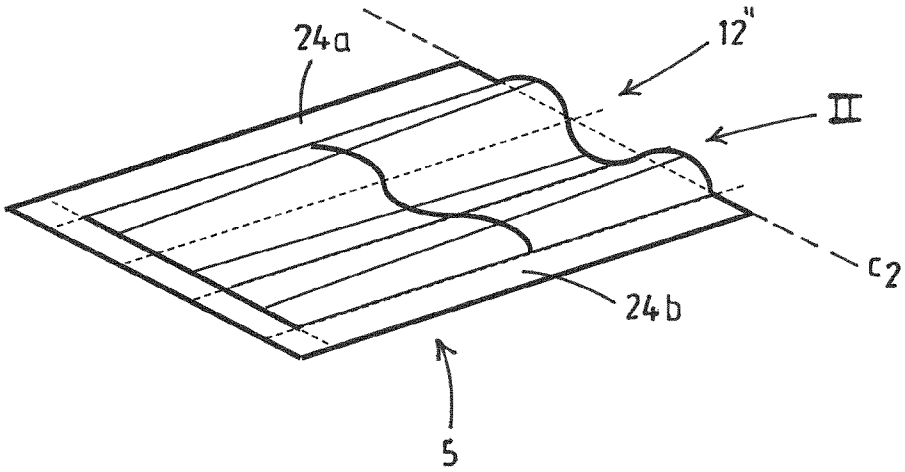
Figure 4A:
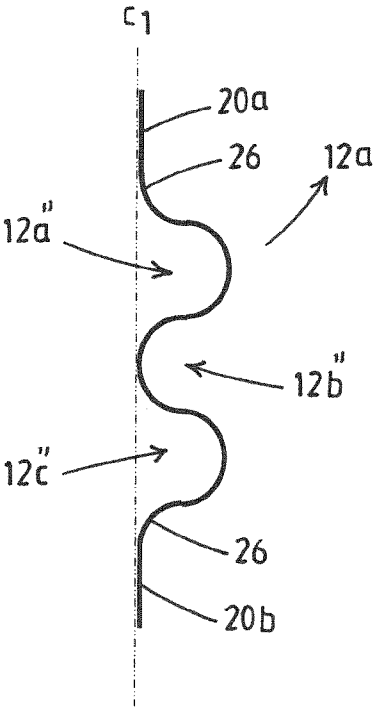
Figure 5C:
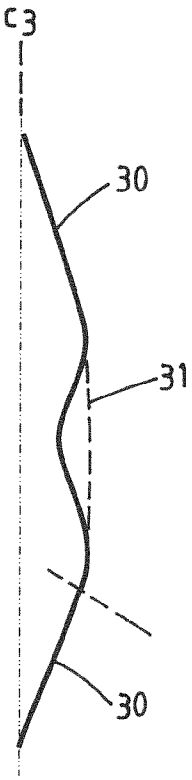
Figure 5B:
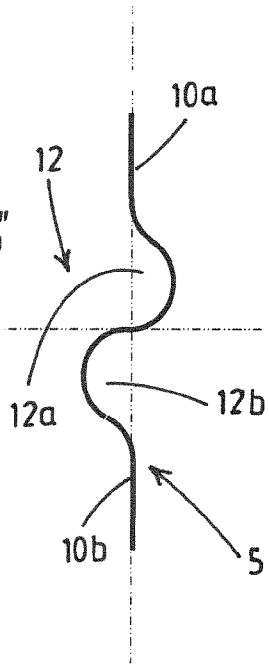
Figure 5A:
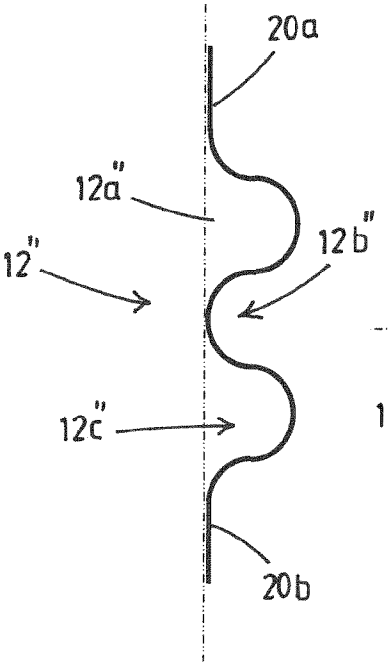
Figure 6B:
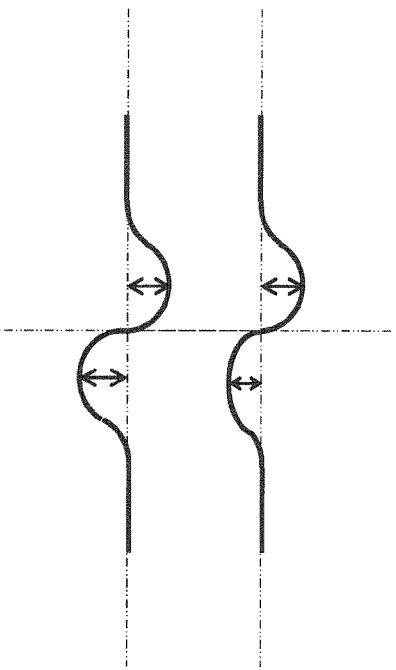
Figure 6A:
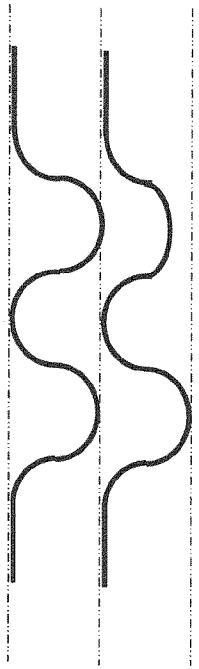
Figure 7G:
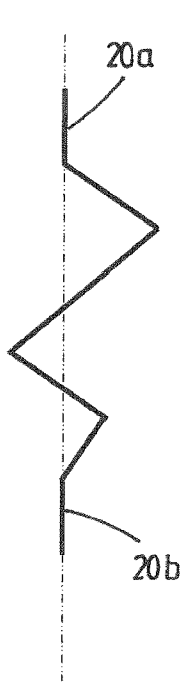
Figure 7F:
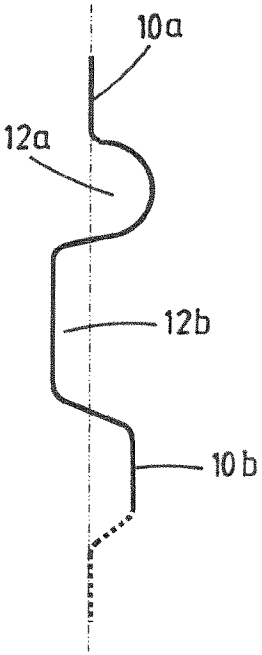
Figure 7E:
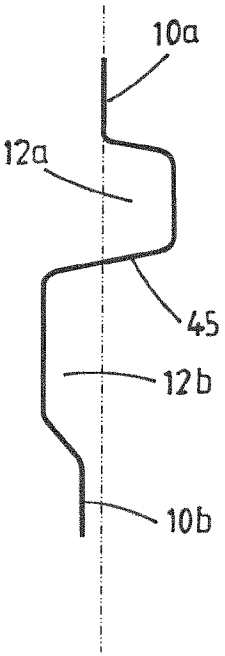
Figure 7D:
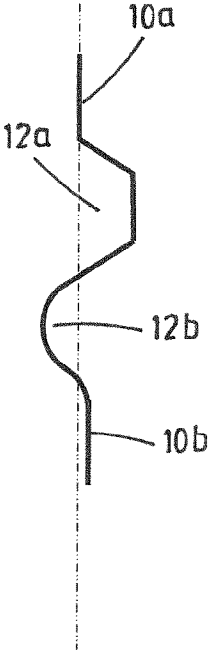
Figure 7C:
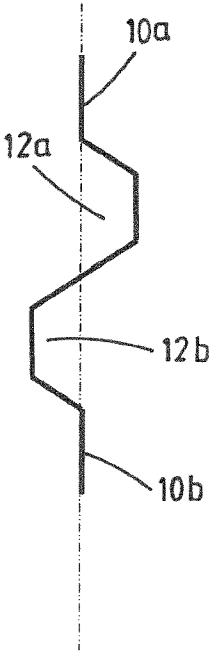
Figure 7B:
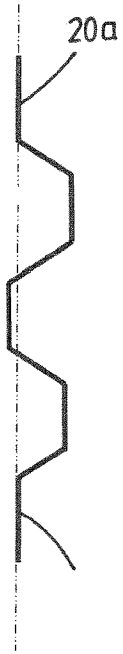
Figure 7A:
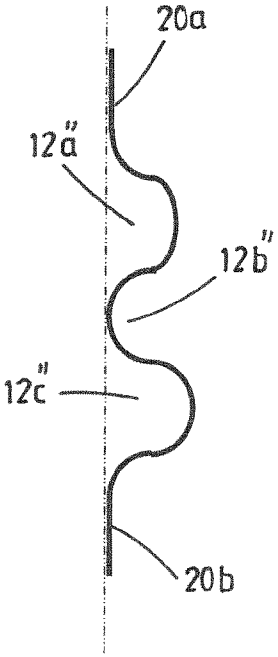
Figure 8:
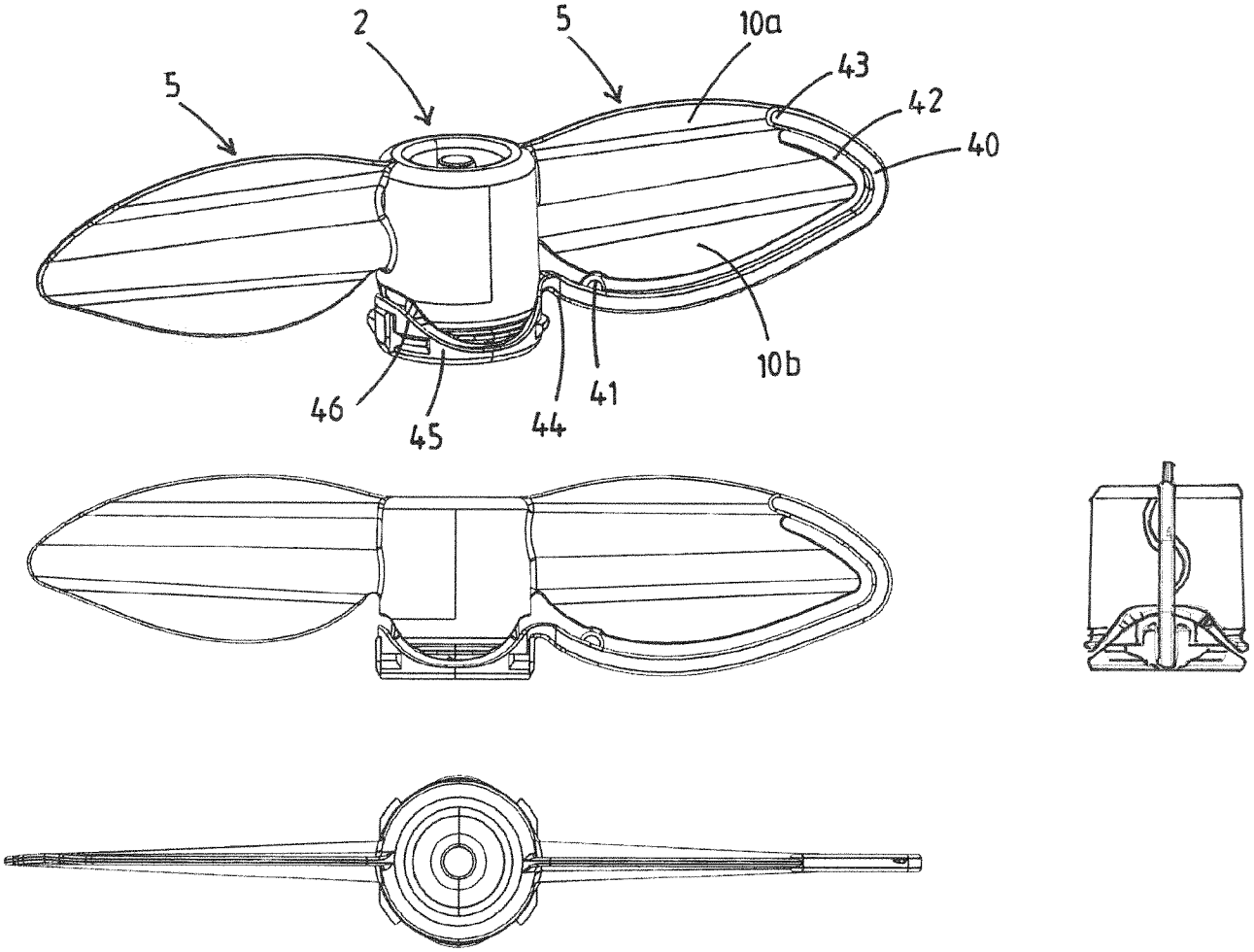
Figure 9:
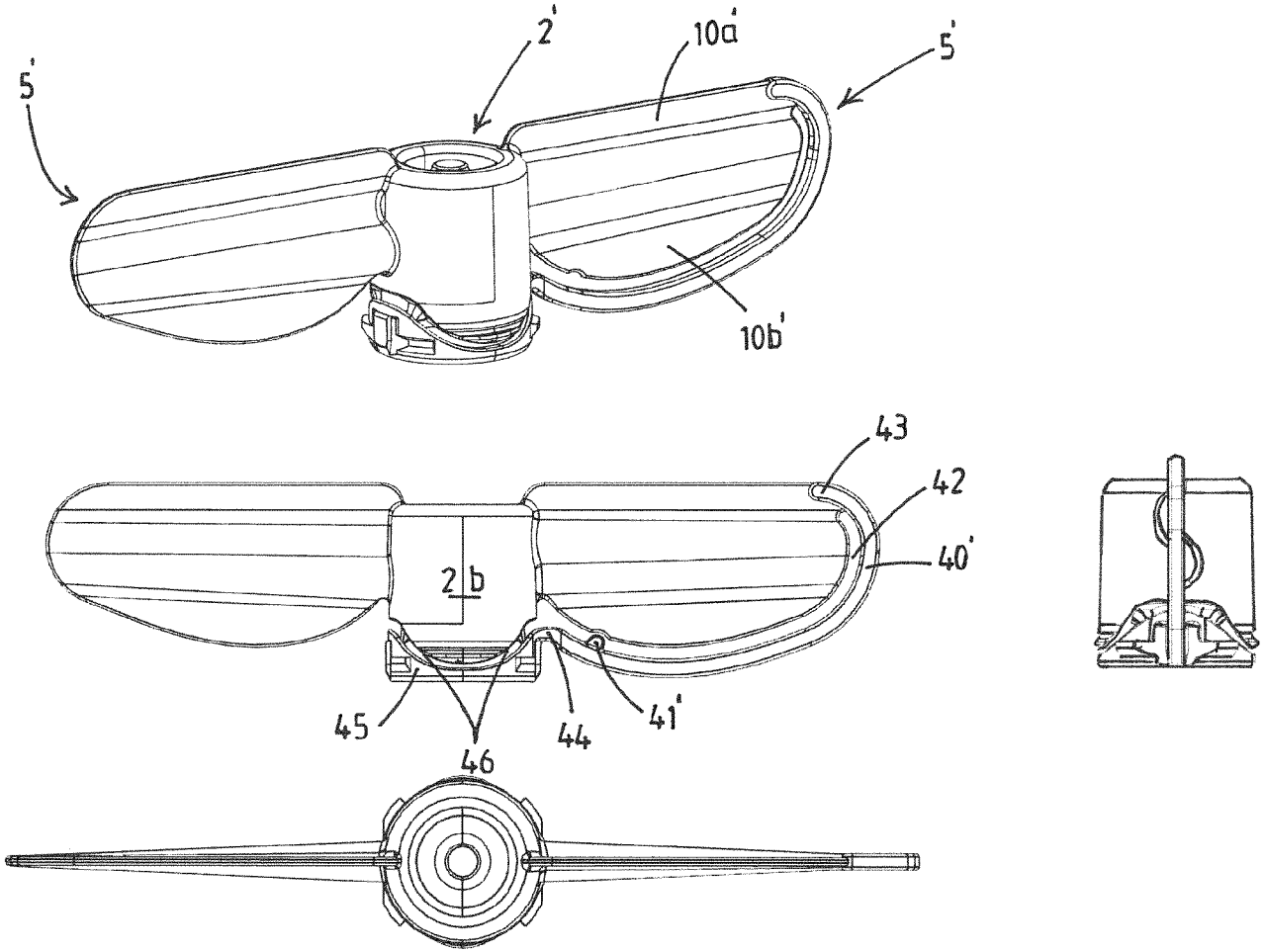
Figure 10:
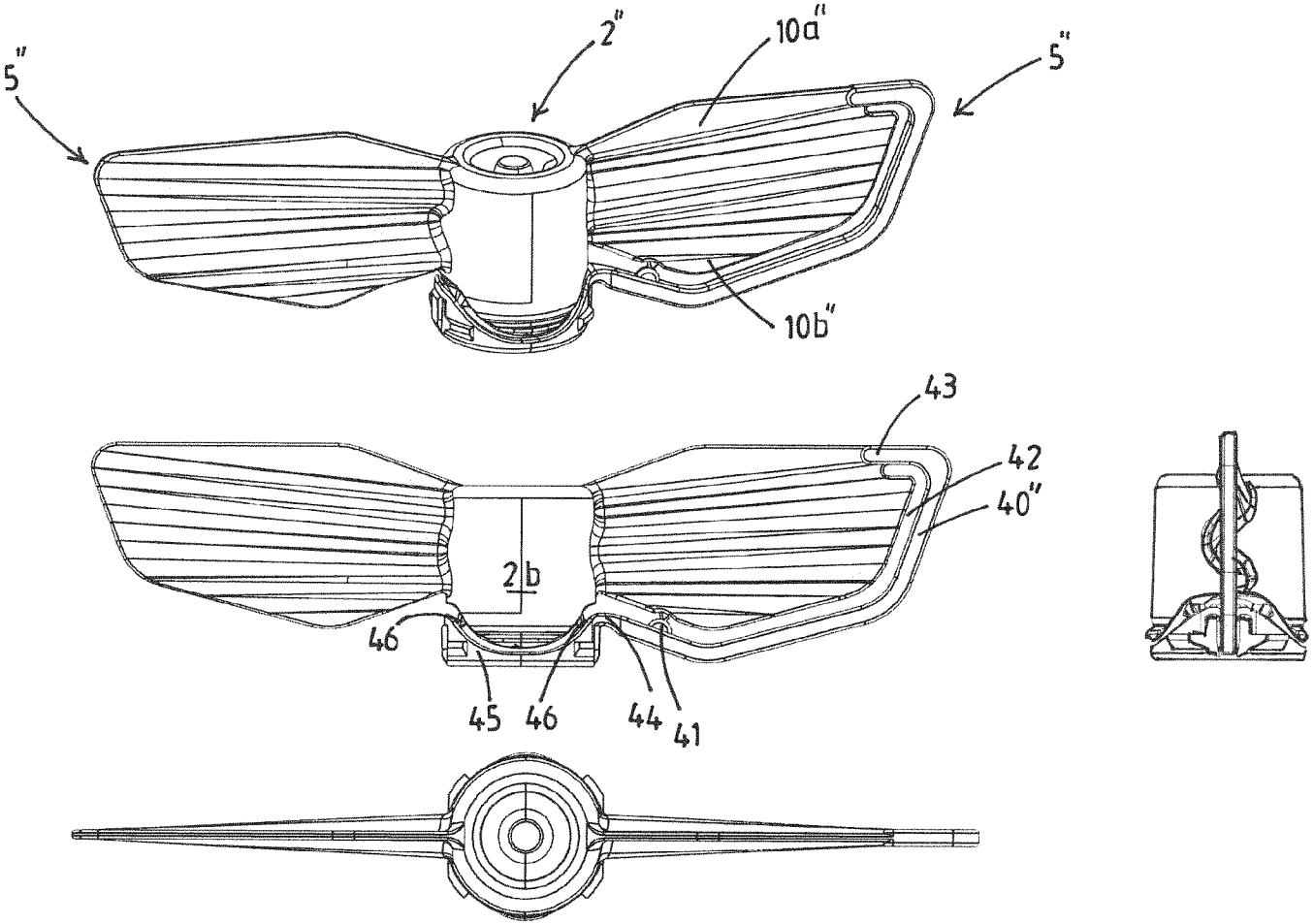

In the drawings:

FIG. 1 shows a schematic of a closure assembly with a winged cap,

FIG. 2 shows a schematic of a closure assembly with an illustrated corrugation in the wings, FIGS. 3*a*, 3*b* and 3*c* show a schematic cross-sectional sideview of a wing of a closure assembly, FIG. 3*d* shows a schematic view of a wing without tapering of the corrugation towards the tip of the wing, FIGS. 3*e* and 3*f* show a schematic view of a wing with illustrated tapering of the corrugation, FIG. 4*a* shows a schematic cross-sectional sideview of a wing with multiple corrugations, FIG. 4*b*, shows a schematic view of a wing with multiple corrugations, FIGS. 5*a*, 5*b* and 5*c* show schematic cross-sectional side views of wings of a closure assembly, FIGS. 6*a* and 6*b* show schematic cross-sectional side views of wings of a closure assembly comprising corrugations with variable heights, FIGS. 7*a*, 7*b*, 7*c*, 7*d*, 7*e*, 7*f* and 7*g* show several schematic cross-sectional side views of wings illustrating various corrugation forms, FIG. 8, shows a first practical embodiment of a closure assembly comprising corrugated wings, FIG. 9, shows a second practical embodiment of a closure assembly comprising corrugated wings, FIG. 10, shows a third practical embodiment of a closure assembly comprising corrugated wings.

FIG. 1 shows a schematic figure of a closure assembly with a winged cap 2.

The closure assembly comprises a spout 1 (mostly hidden by the cap 2). The spout 1 has spout body that is injection moulded of plastic material.

The figure shows an attachment portion 3 of the spout body that is sealed to a container 4.

Not visible is the tubular neck above the portion 3 as it is hidden under the cap. As known in the art, a product passage extends through the attachment portion and the neck of the spout. The tubular neck has a vertical main axis and forms a mouth at a top end of the product passage allowing to dispense a product from the container 4. The neck has an exterior side.

The cap 2 is a rotational cap that is injection moulded of plastic material and that illustrated in a position secured on the neck of the spout in a closed position of the cap 2 on the neck such that the cap seals the product passage. The cap 2, for removal of the cap from the neck of the spout by a user to open the product passage, is adapted to be manually rotated from the closed position in an opening direction.

Generally, the plastic cap 2 comprises a top wall 2*a* and a downward depending skirt 2*b*. The skirt has an interior side, an exterior side, and a lower edge remote from the top wall 2*a*. For example, a tamper-evident structure is provided at the lower edge of the skirt.

The cap 2 has two wings 5, so a single pair of wings 5. It is illustrated, as preferred, that—in view from above—the two wings 5 of the cap 2 are generally aligned with a top edge of the pouch 4 when the cap is closed, e.g. before first time opening of the closure.

The wings 5 are integrally moulded of plastic material with the rest of the cap 2. The wings 5 extend generally vertically and outward in a lateral direction over a wing length in substantially opposite directions from an inner end to a tip of the wing that is remote from the skirt.

In FIG. 2 the same schematic figure of a closure assembly is shown with the addition of a schematic illustration of a single corrugation 6 according to the invention in a center portion of the wing. The wings 5 are shown to each further include a flat top portion 10*a* and a flat base portion 10*b*, respectively above and below the center portion with the corrugation.

In FIG. 2, the flat top portion 10*a* and a flat base portion 10*b* extend in a common vertical plane.

The point where the wing 5 connects with the skirt cap is referred to as the inner end or junction 7 of the wing.

The end of the wing furthest away from the skirt 2*b* cap is referred to as the tip 8 of the wing 5. It is illustrated that the wing tip is a flat wing tip 11 that adjoins the ends of the portion 10*a*, 10*b* to form a flat contour along the top, tip, and bottom delineation of the corrugated center portion.

Furthermore a cross sectional indication line X is shown illustrating a cross section location used for further clarification of the corrugation.

FIGS. 3*a*, 3*b* and 3*c* show side views of three different embodiments of a wing of the closure assembly, seen in direction of arrow III in FIG. 2.

The side view 3*a* illustrates a corrugation 12 in the wing 5 of the closure assembly with an alternating waveform, here a sinusoidal shape, wherein the corrugation 12 does not taper to the edges and the tip of the wing 5. So, both the depth "d" and the height "h" of the grooves 12*a*, 12*b* associated with the single corrugation 12 are constant over the length of the corrugation.

In FIG. 3*a* the flat top portion 10*a*, and flat bottom portion 10*b* extend in a common vertical plane.

In FIG. 3*a*, the corrugation 12 extends in sinusoidal form relative to a vertical plane.

FIG. 3*b* shows a corrugation 12' that tapers off towards the tip 11 of the wing 5. This tapering can be recognized by several cross sections X1, X2 and X3 shown in FIG. 3*b*, which correspond to various positions along the length of the wing 5 such that a reduced amplitude of the sinusoidal shape at each cross section towards the tip of the wing becomes apparent. As preferred, the greatest depth of the grooves 12*a,b* is where the center portion adjoins the skirt 2*b* of the cap.

In FIG. 3*c* a corrugation 12' is illustrated that not only tapers towards the tip 11 of the wing 5 but simultaneously tapers towards a lengthwise axis of the wing 5. In the illustrated embodiment, this tapering occurs towards an axis along the middle of the wing in lengthwise direction but an axis under an angle or an axis translated over the width of the wing can be envisioned as alternative embodiments. It is illustrated in the cross-sections X4, X5, X6 that both the depth and the height of the grooves associated with the corrugation reduces from the inner end of the wing 5 towards the tip of the wing.

FIGS. 3*d*, 3*e* and 3*f* each show a schematic 3-dimensional representation of an embodiment of a corrugated wing according to the invention.

FIG. 3*d* matches with FIG. 3*a*, wherein the sinusoidal shape of the corrugation 12 does not taper off towards the tip of the wing 5.

FIG. 3*e* matches with FIG. 3*b*, wherein the sinusoidal shape of the corrugation 12' can be seen to taper off towards the tip of the wing 5 by a diminishing amplitude of the sinusoidal shape towards the tip of the wing.

FIG. 3*f* matches with FIG. 3*c*, wherein the sinusoidal shape of the corrugation can be seen to taper off towards the tip of the wing as well as towards an axis M along the length of the wing.

From the schematic 3-dimensional representations of the wing embodiments in FIGS. 3*d*, 3*e* and 3*f* it can also be seen that the wing 5 comprises, in addition to the corrugation 12 or 12', the flat portions 10*a*, 10*b* above and below the center portion with the corrugation 12 or 12'.

A tip zone 11 located at the tip of the wing which can, but not necessarily is, substantially flat.

The corrugations in the wings of FIGS. 2 and 3*a*, 3*b*, 3*c*, 3*d*, 3*e* have a single peak and a single valley in the cross-sectional sinusoidal shape of the corrugation 12 and 12'.

The one or more corrugations of the wing center portion comprise a minimum of a one peak and one valley, e.g. in sinusoidal form.

A corrugated wing can comprise more than a single corrugation, e.g. as is shown in FIGS. 4*a* and 4*b*.

Depending on the direction from which one sees the embodiment of the wing in FIG. 4*a* either two valleys and one peak or two peaks and one valley is shown thus giving 1.5 (one and a half) corrugation 12" in the wing of FIG. 4*a*. Three grooves 12*a*", 12*b*", and 12*c*" are present.

FIG. 4*b* is a 3-dimensional schematic representation of a corrugated wing embodiment similar to the sideways cross-sectional view of 4*a* with a few notable differences.

The first notable difference is the axis C1 along the sinusoidal shape in FIG. 4*a* which coincides with the substantially flat portions 20*a, b* such that the peaks and valleys of the corrugations are on one side of the axis C1. This as opposed to the axis C2 in FIG. 4*b* which cuts the corrugation such that the single valley lies below the axis C2 while the two peaks lie above the axis C2 when seen from the direction II along the length of the wing as shown in FIG. 4*b*.

From peak to valley and vice versa the corrugations in FIG. 4*b* transition through the axis C2 whereas the corrugations of FIG. 4*a* do not.

The substantially flat portions 24*a, b* from FIG. 4*b* still coincide with the axis C2 as is the case with the corrugations of FIG. 4*a*.

This illustrates that the corrugations can in principle be lifted out of or sunk into the plane defined by the wing 5. This lifting or sinking of the corrugations can in embodiments be beneficial for production purposes, ease of use, stiffness, storage etc.

Secondly, another observable difference between the corrugations of FIGS. 4*a* and 4*b* are the smooth transitions 26 from the corrugation center portion to the substantially flat base and top portions 20*a, b* of the wing. These smooth transitions can in embodiments be omitted or introduced. The introduction or omission of which would serve aesthetics, production purposes, or ease of use.

FIGS. 5*a* and 5*b* again show these differences more clearly by setting the cross sectional view of a single corrugation in FIG. 5*b* alternating through a centerline next to a cross sectional view of 1.5× corrugations lifted out of the plane such that the corrugations do not cross the line coinciding with the edge zones.

Both corrugations in FIGS. 5*a* and 5*b* illustrate the smooth transitions from the corrugations to the edge zones.

In yet another embodiment similar to the corrugations of FIG. 5*a* are the 1.5× corrugations seen in FIG. 5*c* wherein the wing has been curved along the curve 31 such that the edge zones 30 of the wing now smoothly transition into the corrugations without a curvature and help form the peaks of the corrugations.

FIG. 5*c* also illustrates that the valley (or peak depending on the viewing direction) does not need to reach or cross the axis C3.

FIGS. 6*a* and 6*b* show that the sinusoidal shape of the corrugations are not required to have equal amplitude and as such can, in embodiments, be varied.

FIGS. 7*a*, 7*b*, 7*c*, 7*d*, 7*e*, 7*f* and 7*g* show several schematic cross-sectional side views of wings illustrating various corrugation forms.

FIG. 7*a* is included as reference again since it is similar to the right side of FIG. 6*a* wherein the cross section comprises 1.5× corrugations and wherein the amplitude of at least one the peaks (or valleys depending on viewing direction) is different from the others.

In FIG. 7*b* a more discretized sinusoidal waveform is shown, wherein the peaks and valleys of the corrugations are now made with straight lines and angles instead of continuous curves as is the case in FIG. 7*a*. The valley in between the two peaks of FIG. 7*b* also crosses the axis that coincides with the two substantially flat edge zones, but in embodiments this valley can coincide or stay on one side of this axis.

It is then understood that in light of the invention, a sinusoidal waveform is meant to include all types of waveforms such as square waves. More specifically, the term sinusoidal waveform is, in light of the invention, used to describe alternating waveforms.

FIG. 7*c* shows a similar discretized sinusoidal waveform as in FIG. 7*b* although here a single corrugation has been used. The corrugation of FIG. 7*c* also crosses the axis that coincides with the two substantially flat edge zones as it transitions from a valley to a peak and vice versa.

In FIG. 7*d* a combination between the discretized and a normal sinusoidal waveform is introduced and furthermore it is shown that the edge zones are intentionally placed on different heights and no longer share a common coinciding axis.

It is not necessary to combine these two characteristics into the same embodiment, e.g. discretized vs. normal and non-coinciding edge zones axis. These characteristics are shown in the same embodiment to illustrate various options.

In FIG. 7*e* another such characteristic is introduced wherein the period of the waveform (i.e. the length of the wave or how far the wave has been stretched) changes within the waveform such that the peak and the valley of the corrugation are of different widths.

We also see from FIG. 7*e* that the discretized waveform has been squished more together resulting in a shape more resembling a square wave. Forming this waveform which more resembles a square wave has an added benefit of increasing the angle of attack of the transitioning line 45 between the valley and the peak of the waveform. Changing the angle of attack of the transitioning line does not require a waveform resembling a square wave but can also be achieved by using the regular sinusoidal waveforms.

By increasing the angle of attack of the transitioning line 45 created by the transition between the valley and the peak of a corrugation the stiffness in the direction perpendicular to the surface of the wing can be influenced.

Furthermore the discretized waveform resembling a square wave of FIG. 7*e* has been provided with smooth transitions instead of sharp edges, although this too is optional and can be omitted in alternative embodiments.

These characteristics have in FIG. 7*e* been combined with different amplitudes of the peak and valley and edge zones without a common coinciding axis.

FIG. 7*f* shows a combination of a rounded regular sinusoidal waveform with a waveform resembling a square wave of different periods with an optional edge zone coinciding axis illustrated by the dotted line.

FIG. 7*g* shows yet another alternating waveform having a triangular or sawtooth shape. Here the waveform comprises 1.5× corrugations wherein the peaks and valleys of the waveform comprise different amplitudes.

For all waveforms, e.g. like the ones described above, more than 1.5× corrugations can be envisioned to be implemented in alternative embodiments. For example, $(1+n\times0.5)$ corrugations for $n\geq0$.

FIG. 8 shows a first practical embodiment of a cap 2 of the closure assembly wherein the top and bottom portions 10*a*, 10*b* along the lengthwise edge of the wings are formed such that the overall wings create a leaflike resemblance.

One the wings of the closure assembly with its leaflike resemblance can here be seen to comprise an integrally formed strap 40 following a part of the contour of the wing.

This strap, and several other embodiments of it, has been previously disclosed in WO2020/221801 and is not a necessary or required part of this invention. It is here nonetheless described for the sake of clarity.

The strap 40 is here integral with the wing at or near the top portion 10*a* at a first attachment point 43.

Starting from the first attachment point 43 at or near the top portion 10*a* of the wing there is provided a cut-out or slot between the strap 40 and the wing 5 along the contour of the tip of the wing and the bottom portion 10*b* of the wing.

The strap further comprises a tamper-evident strap part 41 bridging the cut-out towards the wing.

The strap is integrated with a base part 45 of the cap 2 at a second attachment point 44. The base part 45 of the cap 2 is configured to be mounted on the attachment portion 3 of the closure assembly. The base part 45 also comprising tamper evident cap parts 46 connecting the base part 45 of the cap with the skirt of the cap 2*b*.

The tip of the wing with regards to the implementation of the corrugation on the strapped wing is here considered to be located before the strap.

A part of the tip zone on the strapped wing is here missing as a result of the cut-out 42.

The (single) corrugation tapers off towards the tip as was illustrated schematically in FIG. 3*d*.

The tip zone of the wing here is not flat but still contains the trailing edges of the tapering corrugation.

FIG. 9 shows a second practical embodiment of a cap 2' of the closure assembly wherein the top portion 10*a* of the wing overlaps more with the cap of the closure assembly. This can add stiffness and may also serve aesthetic purposes.

The bottom portions 10*b* of the wings in FIG. 9 are, in this embodiment, purely there for aesthetic purposes since they do not add stiffness to the wing when no bridging connection is made with the cap body.

Here one of the wings again comprises a strap 40' following the contour of the second embodiment of the wing. The strapped wing here also comprising a tamper-evident strap part 41, a cut-out 42, a first attachment point 43 and a second attachment point 44.

The cap 2 comprises a base part 45 and tamper-evident cap parts 46.

FIG. 10 shows a third practical embodiment of a cap 2" of the closure assembly wherein the wings have been provided with discretized corrugations similar to as was illustrated schematically in FIG. 7*b*.

In the practical embodiment of FIG. 10 however the corrugations taper off under an angle from the cap to the tip of the wings, similar to that which was described in the text corresponding to FIG. 3*c*.

Just as in the previous two embodiments one of the wings comprises a strap 40". Here following the contour of the third embodiment of the wing. The strapped wing here also comprising a tamper-evident part 41, a cut-out 42, a first attachment point 43 and a second attachment point 44. The cap 2 comprises a base part 45 and tamper-evident cap parts 46.

The invention claimed is:

1. A closure assembly for a container, comprising:

a spout having a spout body that is injection moulded from a plastic material, the spout body having, an attachment portion configured to be sealed or sealed to a container, a tubular neck, wherein a product passage extends through the attachment portion and the tubular neck of the spout, the tubular neck having a vertical main axis and forming a mouth at a top end of the product passage allowing dispensing of a product from the container, the tubular neck having an exterior side;

a rotational cap that is injection moulded from a plastic material and that is secured on or is to be secured on the tubular neck of the spout in a closed position of the rotational cap on the tubular neck such that the rotational cap seals the product passage, and removal of the rotational cap from the tubular neck of the spout by a user, tewill open the product passage, wherein the rotational cap is adapted to be manually rotated in an opening direction from the closed position to an open position;

wherein the rotational cap comprises a top wall and a downward depending skirt, the skirt having an interior side, an exterior side, and a lower edge remote from the top wall, wherein the rotational cap has two wings, which are integrally moulded from a plastic material and extend vertically and outward in a lateral direction over a wing length in substantially opposite directions from an inner end to a tip, wherein the two wings each have a base portion, a center portion, a top portion, a front side and a back sides, wherein the front side is opposite the back side, wherein the base portion is located below the center portion and the top portion is located above the center portion, wherein at least the center portion of each wing is connected to the skirt of the rotational cap, wherein the base portion and the top portion of each wing are substantially flat, and wherein the center portion of each wing comprises at least one corrugation that extends along a part of the length of the wing and forms a groove on both sides of the wing, which the grooves of the corrugation, as seen from a sideways view of the wing, together form an alternating waveform.

2. The closure assembly according to claim 1, wherein, seen in a view from above, the at least one corrugation in the center portion of the wing tapers off towards the tip of the wing.

3. The closure assembly according to claim 2, the at least one corrugation in the center portion of the wing merges with the substantially flat base portion and the substantially flat top portion of the wing.

4. The closure assembly according to claim 1, wherein the at least one corrugation is substantially parallel to the lateral extending direction of the wings.

5. The closure assembly according to claim 1, wherein the one or more corrugations are perpendicular to the vertical main axis of the tubular neck at least in a closed configuration of the closure assembly.

6. The closure assembly according to claim 1, wherein the one at least one corrugation extends at an angle of less than 60 degrees with respect to the lateral extending direction of the wings.

7. The closure assembly according to claim 1, wherein the at least one corrugation extends at an angle of less than 45 degrees with respect to the lateral extending direction of the wings.

8. The closure assembly according to claim 1, wherein the at least one corrugation tapers off towards the tip of the wing along the length of the wing.

9. The closure assembly according to claim 8, wherein the tapering of the corrugation towards the tip of the wing along the length of the wing is such that the tip of the wing is substantially flat.

10. The closure assembly according to claim 1, wherein the largest height of the one or more corrugations is less than 80% of the largest height of the wing.

11. The closure assembly according to claim 1, wherein the one or more corrugations span the length of the center portion of the wing.

12. The closure assembly according to claim 1, wherein the depth and/or height of the one or more corrugations is largest at an inner part of the wing.

13. The closure assembly according to claim 1, wherein the largest depth and/or height of the one or more corrugations is around-2 mm to 5 mm.

14. The closure assembly according to claim 1, wherein the center portion of the wings is larger than the top portion and/or the base portion.

15. The closure assembly according to claim 1, wherein the center part of the wing comprises at least two corrugations.

16. The closure assembly according to claim 1, wherein the center part of the wing comprises corrugations formed in opposite directions, wherein the corrugations are offset from a main surface of the wing such that one of the two sides of the wing does not have any protrusions past its surface as a result of the corrugations.

17. The closure assembly according to claim 1, wherein the one or more corrugations, as seen from the side of the wing, have a sinusoidal shape.

18. The closure assembly according to claim 1, wherein the corrugations, as seen from the side of the wing, have a shape similar to a square wave.

19. A container provided with the closure assembly according to claim 1.

* * * * *